US010390137B2

(12) United States Patent
Bharitkar

(10) Patent No.: US 10,390,137 B2
(45) Date of Patent: Aug. 20, 2019

(54) DOMINANT FREQUENCY PROCESSING OF AUDIO SIGNALS

(71) Applicant: HEWLETT-PACKARD DEVELOPMENT COMPANY, L.P., Houston, TX (US)

(72) Inventor: Sunil Bharitkar, Palo Alto, CA (US)

(73) Assignee: Hewlett-Packard Dvelopment Company, L.P., Spring, TX (US)

( * ) Notice: Subject to any disclaimer, the term of this patent is extended or adjusted under 35 U.S.C. 154(b) by 0 days.

(21) Appl. No.: 16/075,642

(22) PCT Filed: Nov. 4, 2016

(86) PCT No.: PCT/US2016/060465

§ 371 (c)(1),
(2) Date: Aug. 4, 2018

(87) PCT Pub. No.: WO2018/084848

PCT Pub. Date: May 11, 2018

(65) Prior Publication Data

US 2019/0052960 A1 Feb. 14, 2019

(51) Int. Cl.

| | |
|---|---|
| ***H04R 3/04*** | (2006.01) |
| ***G10L 25/12*** | (2013.01) |
| ***G10L 21/038*** | (2013.01) |

(52) U.S. Cl.
CPC ..... *H04R 3/04* (2013.01); *G10L 21/038* (2013.01); *G10L 25/12* (2013.01)

(58) Field of Classification Search
CPC ..... G10L 21/038; G10L 25/12; H04R 3/04
See application file for complete search history.

(56) References Cited

U.S. PATENT DOCUMENTS 6,296,489 B1 * 10/2001 Blass ..... G09B 19/04 434/185
6,792,115 B1 * 9/2004 Vierthaler ..... H04R 3/04 381/61

(Continued)

FOREIGN PATENT DOCUMENTS

WO 02097791 A1 12/2002
WO 2016109500 A1 7/2016

OTHER PUBLICATIONS

Chen et al., "Pitch Marking Based on an Adaptable Filter and a Peak-Valley Estimation Method", Computational Linguistics and Chinese Language Processing, vol. 6, No. 2, Retrieved from Internet—http://www.aclclp.org.tw/clclp/v6n2/v6n2a3.pdf, 2001, pp. 31-42.

(Continued)

*Primary Examiner* — Regina N Holder
(74) *Attorney, Agent, or Firm* — HP Inc. Patent Department

(57) ABSTRACT

An example non-transitory computer-readable medium includes instructions. When executed by a processor, the instructions cause the processor to remove nondominant frequencies from a low frequency portion of an audio signal. The instructions also cause the processor to apply non-linear processing to a remainder of the low frequency portion to generate a plurality of harmonics. The instructions cause the processor to insert the plurality of harmonics into an audio output corresponding to a high frequency portion of the audio signal. The audio output is to be provided to an audio output device.

15 Claims, 6 Drawing Sheets

(56) References Cited

U.S. PATENT DOCUMENTS

| | | | | |
|---|---|---|---|---|
| 7,366,659 | B2 | 4/2008 | Etter | |
| 7,461,002 | B2 * | 12/2008 | Crockett | 704/200.1 |
| 7,660,718 | B2 | 2/2010 | Kabi et al. | |
| 9,258,428 | B2 | 2/2016 | Caramma | |
| 2008/0159551 | A1 | 7/2008 | Harley et al. | |
| 2015/0073784 | A1 | 3/2015 | Gao | |
| 2015/0228288 | A1 | 8/2015 | Subasingha et al. | |
| 2015/0279383 | A1 | 10/2015 | Crockett | |

OTHER PUBLICATIONS

Carruthers, "Develop a Microcontroller Based System Capable of Capturing a Stream of Musical Notes", Retrieved from Internet—http://www.dweb-x.com/report.pdf, General Computing Project, 2016, 77 Pages.

Firth, "Minimising Latency of Pitch Detection Algorithms for Live Vocals on Low-Cost Hardware", University of Huddersfield Repository, Retrieved from Internet—http://eprints.hud.ac.uk/id/eprint/26731/1/2112.pdf, 2016, 22 Pages.

* cited by examiner

DOMINANT FREQUENCY PROCESSING OF AUDIO SIGNALS

BACKGROUND

A computing device may include a plurality of user interface components. For example, the computing device may include a display to produce images viewable by a user. The computing device may include a mouse, a keyboard, a touchscreen, or the like to allow the user provide input. The computing device may also include a speaker, a headphone jack, or the like to produce audio that can be heard by the user. The user may listen to various types of audio with the computer, such as music, sound associated with a video, the voice of another person (e.g., a voice transmitted in real time over a network), or the like. In some examples, the computing device may be a desktop computer, an all-in-one computer, a mobile device (e.g., a notebook, a tablet, a mobile phone, etc.), or the like.

DETAILED DESCRIPTION

In some examples, the computing device may be small to reduce weight and size, which may make the computing device easier for a user to transport. The computing device may have speakers with limited capabilities. For example, the speakers may be small to fit within the computing device and to reduce the weight contributed by the speakers. However, small speakers may provide a poor frequency response at low frequencies. The speaker drivers may be unable to push enough volume of air to produce low frequency tones at a reasonable volume. Accordingly, the low frequency portions of an audio signal may be lost when the audio signal is played by the computing device.

To compensate for the loss of low frequencies, the audio signal may be modified to create the perception of the low frequency component being present. In an example, harmonics of the low frequency signals may be added to the audio signal. The inclusion of the harmonics may create the perception that the fundamental frequency is present even though the speaker is unable to produce the fundamental frequency. In some examples, the harmonics may be produced by applying non-linear processing to a low frequency portion of the audio signal. However, the non-linear processing may create intermodulation distortion that is added to the audio signal. For example, there may be a plurality of low frequency components, and the non-linear processing may create intermodulation products and beating. When the harmonics are added to the audio signal, the intermodulation distortion may cause the audio signal to have less clarity and sound muddy.

In addition, the audio signal may include a plurality of audio channels to be output to a plurality of speakers. The audio channels may be combined before applying the non-linear processing. However, phase differences may cause cancellation or damping of components in the audio signal. For example, a plurality of microphones originally recording the audio may have been different distances from the audio source. As a result, the corresponding harmonics may also be damped or canceled, and the low frequency component to be perceived by the listener may be less noticeable. Accordingly, the audio quality of audio output from speakers in computing devices may be improved by removing intermodulation distortion from audio signals and preventing damping or cancellation due to phase differences in the audio channels.

Figure 1:
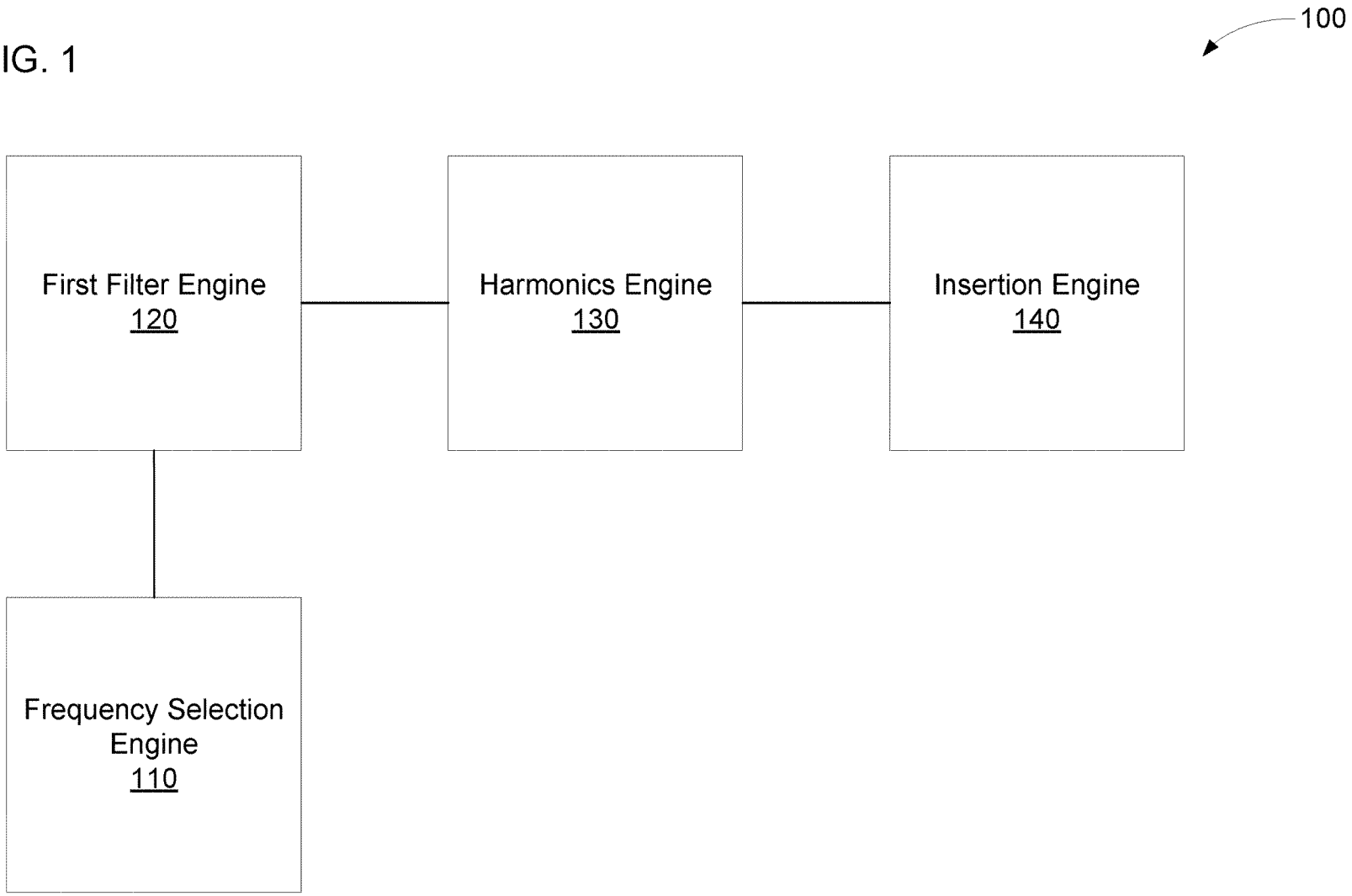
FIG. 1 is a block diagram of an example system to produce an audio output that creates the perception of a low frequency component.

FIG. 1 is a block diagram of an example system 100 produce an audio output that creates the perception of a low frequency component. The system 100 may include a frequency selection engine 110. As used herein, the term "engine" refers to hardware (e.g., a processor, such as an integrated circuit or other circuitry) or a combination of software (e.g., programming such as machine- or processor-executable instructions, commands, or code such as firmware, a device driver, programming, object code, etc.) and hardware. Hardware includes a hardware element with no software elements such as an application specific integrated circuit (ASIC), a Field Programmable Gate Array (FPGA), etc. A combination of hardware and software includes software hosted at hardware (e.g., a software module that is stored at a processor-readable memory such as random access memory (RAM), a hard-disk or solid-state drive, resistive memory, or optical media such as a digital versatile disc (DVD), and/or executed or interpreted by a processor), or hardware and software hosted at hardware. The frequency selection engine 110 may select a dominant frequency in an audio signal. For example, the audio signal may include a plurality of frequency components, and the frequency selection engine 110 may select a frequency component that is most dominant. The frequency selection engine 110 may select a dominant frequency in a particular band or time segment of the audio signal smaller than the entire band or length of the audio signal. The audio signal may be an analog or a digital audio signal.

The system 100 may include a first filter engine 120. The first filter engine 120 may extract the dominant frequency from the audio signal. The frequency selection engine 110 may indicate the dominant frequency to the first filter engine 120. The first filter engine 120 may remove or dampen frequencies other than the dominant frequency to produce a signal that includes the dominant frequency without including other frequencies.

The system 100 may include a harmonics engine 130. The harmonics engine 130 may generate a plurality of harmonics of the dominant frequency. The first filter engine 120 may provide the signal that includes the dominant frequency to the harmonics engine 130. The harmonics engine 130 may produce a signal that includes the plurality of harmonics.

The system 100 may include an insertion engine 140. The insertion engine 140 may insert the plurality of harmonics into an audio output corresponding to the audio signal. The audio output may include a portion of the audio signal (e.g., a channel of the audio signal, a particular band of the audio signal, etc.), a modified version of the audio signal (e.g., after additional processing), or the like. The insertion engine 140 may insert the plurality of harmonics into the audio output by combining the signal that includes the plurality of harmonics with the audio output. The audio output may be to be provided to an audio output device (e.g., a speaker, a headphone, etc.). For example, the audio output may be provided directly or indirectly to the audio output after insertion of the plurality of harmonics. In some examples, the audio output may be stored or buffered for later output by an audio output device.

Figure 2:
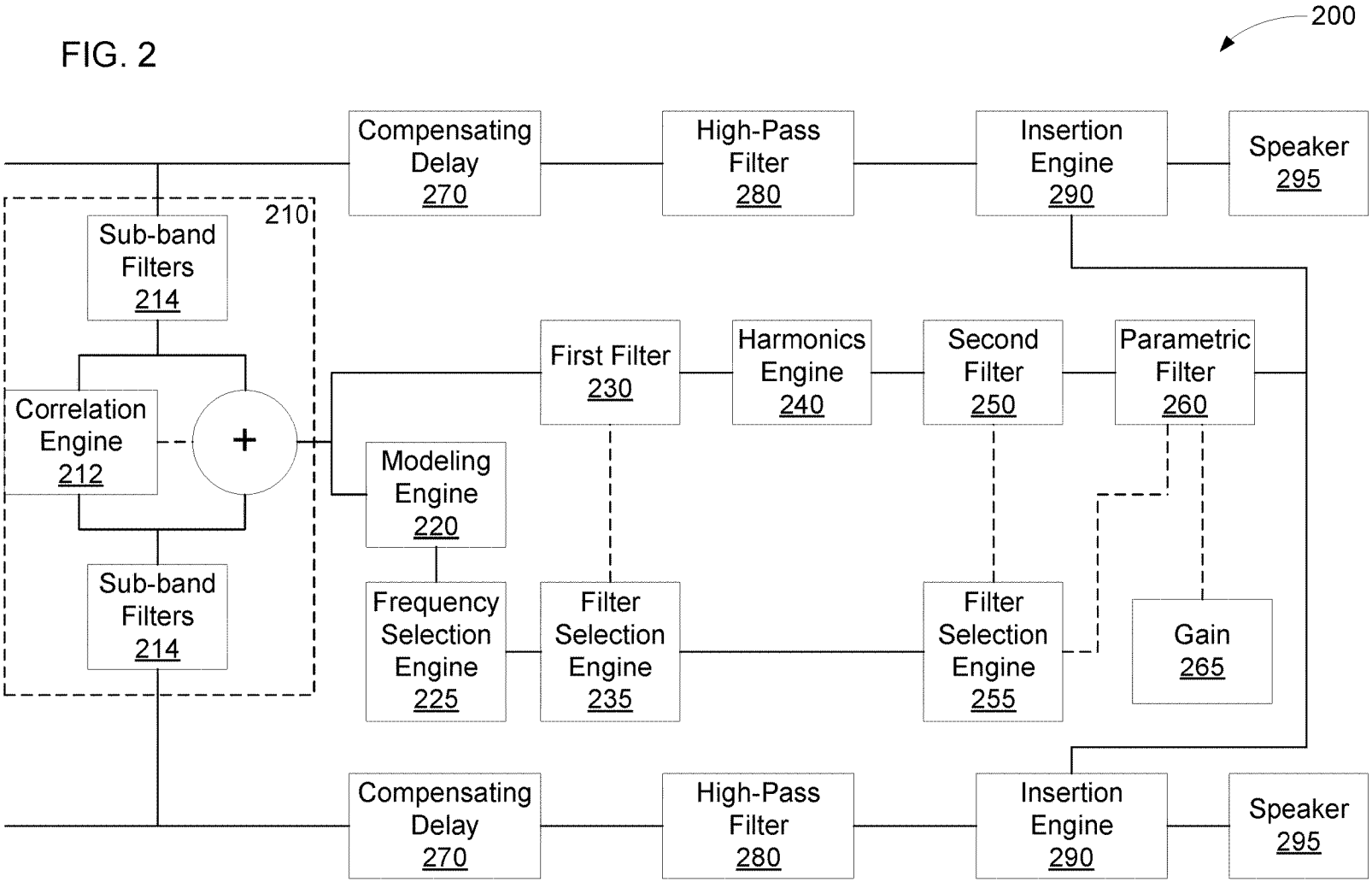
FIG. 2 is a block diagram of another example system to produce an audio output that creates the perception of a low frequency component.

FIG. 2 is a block diagram of another example system 200 to produce an audio output that creates the perception of a low frequency component. The system 200 may include an alignment engine 210. The alignment engine 210 may time align channel signals to produce the audio signal. For example, the alignment engine 210 may receive channel signals from a plurality of audio channels. The alignment engine 210 may align the channel signals and combine them to produce a combined audio signal. In some examples, there may be a single audio channel, and the alignment engine 210 may be omitted.

The alignment engine 210 may include a correlation engine 212. The correlation engine 212 may measure a correlation between the channel signals to determine how the channel signals should be aligned. In an example, the correlation engine 212 may compute a cross-correlation between the channel signals. The correlation engine 212 may determine an offset between the channel signals based on when a maximum occurs in the cross-correlation.

In some examples, the alignment engine 210 may include a sub-band filters engine 214 to apply a plurality of sub-band filters. The plurality of sub-band filters may split each channel signal into a plurality of channel sub-band signals. Each sub-band filter may include a passband, and the sub-band filter may maintain portions of the channel signal in the passband while removing or damping portion of the channel signal outside the passband. A copy of each channel signal may be passed through each sub-band filter to produce the plurality of channel sub-band signals. The plurality of sub-band filters may have neighboring, overlapping, or nearby passbands, so the plurality of sub-band signals may resemble the spectrum of the channel signals split into a plurality of sub-bands.

In examples that include a plurality of sub-band filters, the correlation engine 212 may determine an offset between corresponding sub-band signals from the plurality of channel signals. The sub-band signals may be corresponding if they were produced by filters having the same or similar passbands. The alignment engine 210 may align each set of corresponding sub-bands based on the offsets determined by the correlation engine 212. The alignment engine 210 may combine all of the time aligned sub-bands from all of the plurality of channel signals to produce the combined audio signal. For example, the alignment engine 210 may sum the time-aligned sub-bands to produce the combined audio signal. Time aligning the plurality of channel signals may prevent phase differences in the channel signals from producing cancelation in the combined audio signal. Different sub-bands may have different phase differences, so time aligning the sub-bands may prevent variations in the phase differences between the sub-bands from canceling some sub-bands while reinforcing others when combining the audio signals.

The system 200 may process frames of samples. In some examples, the frames of samples may be non-overlapping. In other examples, the frames of samples may be overlapping, such as by advancing the frame one sample at a time, by a fraction of a frame (e.g., ¾, ⅔, ½, ⅓, ¼, etc.). Non-overlapping frames may allow for faster processing, which may prevent audio from becoming noticeably from unsynchronized with related video signals. Overlapping frames may track changes in dominant frequencies more smoothly. The frame size may be predetermined based on a sampling frequency, a lowest pitch to be detected (e.g., a lowest pitch audible to a human listener), or the like. The frame size may correspond to a predetermined multiple of the period of the lowest pitch to be detected. The predetermined multiple may be, for example, 0.5, 1, 1.5, 2, 2.5, 3, 3.5, 4, 4.5, 5, etc. A higher multiple may increase accuracy but involve processing of a larger number of samples.

The system 200 may include a modeling engine 220. The modeling engine 220 may generate a linear predictive coding (LPC) model of the audio signal (e.g., an LPC model of the combined audio signal from the alignment engine 210 or the like). The modeling engine 220 may determine an LPC model that minimizes an error between the audio signal and the LPC model. In some examples, the LPC model may have an order 128, 256, 512, 1024, 2048, 4096, 8092, etc. The LPC model may have a spectrum that corresponds to a smoothed version of the spectrum of the audio signal. Accordingly, the modeling engine 220 may remove unnecessary detail that might otherwise obscure peaks in the spectrum. In some examples, smoothing techniques other than an LPC model may be used, such as convoluting the spectrum with a smoothing filter (e.g., a Gaussian filter, etc.) or the like.

The system 200 may include a frequency selection engine 225. The frequency selection engine 225 may select a dominant frequency in an audio signal. For example, the frequency selection engine 225 may detect a maximum in the spectrum of the LPC model of the audio signal or in a low frequency portion of the spectrum of the LPC model. The frequency selection engine 225 may detect the maximum in the spectrum of the LPC model of the audio signal based on the gradient of the LPC spectrum. In some examples, the frequency selection engine 225 may select a predetermined number of dominant frequencies in the audio signal (e.g., one, two, three, four, five, etc.), may select each maximum with a value above a predetermined threshold, may select maxima that are more than a predetermined distance apart, a combination of such criteria, or the like. Performance of the frequency selection engine 225 may be improved by including the alignment engine 210, which may prevent phase differences from damping or obscuring the dominant frequency. Similarly, the modeling engine 220, by removing details that might obscure peaks in the spectrum, may improve performance of the frequency selection engine 225 in selecting the dominant frequency.

In some examples, the frequency selection engine 225 may include a smoothing filter to prevent large changes in the dominant frequency between frames. For example, for non-overlapping frames or overlapping frames with large advances, the dominant frequency may change rapidly between frames, which may produce noticeable artifacts in the audio output. The smoothing filter may cause the dominant frequency to change gradually from one frame to the next. Accordingly, large frame advances can be used to improve processing performance without creating artifacts in the audio output.

The system 200 may include a first filter selection engine 235. The first filter selection engine 235 may select a first filter corresponding to the dominant frequency in the audio signal. For example, the first filter selection engine 235 may select a first filter with a passband corresponding to a critical band of an auditory filter. As used herein, the term "auditory filter" refers to any filter from a set of overlapping filters that can be used to model the response of the basilar membrane to sound. As used herein, the term "critical band" refers to the passband of a particular auditory filter. In an example, the first filter selection engine 235 may select a first filter corresponding to an auditory filter with a center frequency closest to the dominant frequency. The first filter selection engine 235 may synthesize the first filter based on the corresponding auditory filter, may load predetermined filter coefficients for the selected first filter, or the like.

The system 200 may include a first filter engine 230 to extract the dominant frequency from the audio signal. The first filter engine 230 may apply the selected first filter to the audio signal to extract the dominant frequency. The first filter engine 230 may dampen the frequency components of the audio signal outside the passband of the selected filter while maintaining frequency components inside the passband of the selected first filter. Accordingly, the filtered signal may include frequency components of the audio signal near the dominant frequency but not include the remainder of the audio signal. There may be a trade-off when selecting filter bandwidth between excluding non-dominant frequency components and cutting off signal components related to the dominant frequency component. By using a filter corresponding to an auditory filter, the first filter engine 230 may balance the trade-off in a manner optimized for human hearing.

The system 200 may include a harmonics engine 240 to generate a plurality of harmonics of the dominant frequency. For example, the harmonics engine 240 may apply non-linear processing to the filtered signal to generate the plurality of harmonics of the dominant frequency. The plurality of harmonics may include signals with frequencies that are integer multiples of the dominant frequency. Because the first filter engine 230 removed frequency components other than the dominant frequency, the harmonics engine 240 may produce less intermodulation distortion and beating than if a wide band filter or no filter had been applied. The harmonics engine 240 may produce a signal that includes the plurality of harmonics and the dominant frequency.

The system 200 may include a second filter engine 250. The second filter engine 250 may extract a subset of the plurality of harmonics. The dominant frequency or some of the harmonics in the plurality of harmonics may be at frequencies below the capabilities of an audio output device, so the second filter engine 250 may remove the dominant frequency or harmonics below the capabilities of the audio output device. Higher harmonics may have little effect in creating the perception of the dominant frequency, so the second filter engine 250 may remove the higher harmonics as well. In some examples, the second filter engine 250 may keep some or all of the second harmonic, third harmonic, fourth harmonic, fifth harmonic, sixth harmonic, seventh harmonic, eighth harmonic, ninth harmonic, tenth harmonic, etc. The second filter engine 250 may output a signal that includes the subset of harmonics.

In some examples, the system 200 may include a second filter selection engine 255. The second filter selection engine 255 may select a second lower cutoff frequency and a second upper cutoff frequency. As used herein, the term "cutoff frequency" refers to a frequency at which signals are attenuated by a particular amount (e.g., 3 dB, 6 dB, 10 dB, etc.) The second filter selection engine 255 may select the cutoff frequencies based on the first filter. The first filter may include a first lower cutoff frequency and a first upper cutoff frequency. The second lower cutoff frequency may be selected to be a first integer multiple of the first lower cutoff frequency, and the second cutoff upper cutoff frequency may be selected to be a second integer multiple of the first upper cutoff frequency. The first and second integers may be different from each other. The first and second integers may be selected so that the second lower cutoff frequency excludes harmonics below the capabilities of the audio output device and the second upper cutoff frequency excludes harmonics that have little effect in creating the perception of the dominant frequency. In an example, the first integer may be two, three, four, five, six, or the like, and the second integer may be three, four, five, six, seven, eight, nine, ten, or the like.

The system 200 may include a parametric filter engine 260 to apply a gain to the signal containing the subset of the harmonics. The parametric filter engine 260 may apply the gain to the signal by applying a parametric filter to the signal containing the subset of the harmonics. The parametric filter engine 260 may receive an indication of the gain to apply from a gain engine 265 and an indication of the second lower and upper cutoff frequencies from the second filter selection engine 255. The parametric filter engine 260 may synthesize the parametric filter based on the gain and second cutoff frequencies. In an example, the parametric filter may be a biquad filter. In some examples, gain may be applied to the signal containing the subset of harmonics without using a parametric filter, e.g., using an amplifier. The parametric filter engine 260 may produce a signal that includes an amplified subset of harmonics.

The system 200 may include an insertion engine 290 to insert the amplified subset of harmonics into an audio output corresponding to the audio signal. As used herein, the term "audio signal" refers to a single channel signal (e.g., a monophonic signal), a plurality of uncombined channel signals (e.g., a stereophonic signal), the audio signal produced from combining a plurality of channel signals, or the audio signal produced from combining time aligned versions of the plurality of channels. Accordingly, as used herein, the term "audio output corresponding to the audio signal" refers to a signal in the same or a different form from the audio signal (e.g., a monophonic form, a stereophonic form, a combined form, a time-aligned combined form, etc.) and that may have undergone additional processing independent of the amplified subset of harmonics. For example, the plurality of channel signals may each have been processed by a compensating delay engine 270 and a high-pass filter engine 280 to produce the audio output as a plurality of uncombined, processed channel signals. The insertion engine 290 may insert the amplified subset of harmonics into each of the processed channel signals. For example, for each channel, the insertion engine 290 may sum the processed channel signal with the amplified subset of harmonics.

In some examples, the system 200 may include the compensating delay engine 270 and the high-pass filter engine 280. The generation of the amplified subset of harmonics may take time. For example, some or all of the engines 210, 212, 214, 220, 225, 230, 235, 240, 250, 255, 260, and 265 may delay the amplified subset of the harmonics relative to the channel signals. Accordingly, the compensating delay engine 270 may delay the channel signals to ensure they will be aligned with the amplified subset of the harmonics when the channel signals and the amplified subset of the harmonics arrive at the insertion engine 290. As previously discussed, the audio output device may be unable to output low frequency components of the channel signals, so the high-pass filter engine 280 may remove such frequency components from the channel signals. For example, the high-pass filter engine 280 may dampen all frequency content below a particular cutoff frequency, which may correspond to the capabilities of the audio output device.

The delayed and filtered channel signals may be provided to the insertion engine 290, which may combine the delay and filtered channel signals with the amplified subset of harmonics to create an audio output with harmonics. The amplified subset of harmonics may create the perception of the dominant low frequency components removed by the high-pass filter engine 280. In the illustrated example, the system 200 may include speakers 295 as audio output devices. Other audio output devices, such as headphones, etc., may be included in addition to or instead of the speakers 295. In some examples, the components of the system 200 may be rearranged. For example, the frequency selection engine 225 may evaluate each channel individually and select the most dominant frequency based on the individual evaluations, and the first filter engine 230 may extract the dominant frequency from each individual channel. In such an example, the alignment engine 210 may align and combine the extracted dominant frequencies from each channel, but the sub-band filters 214 may be omitted. The combined signal may be provided to the harmonics engine 240, which may process the combined signal as previously discussed.

Figure 3:
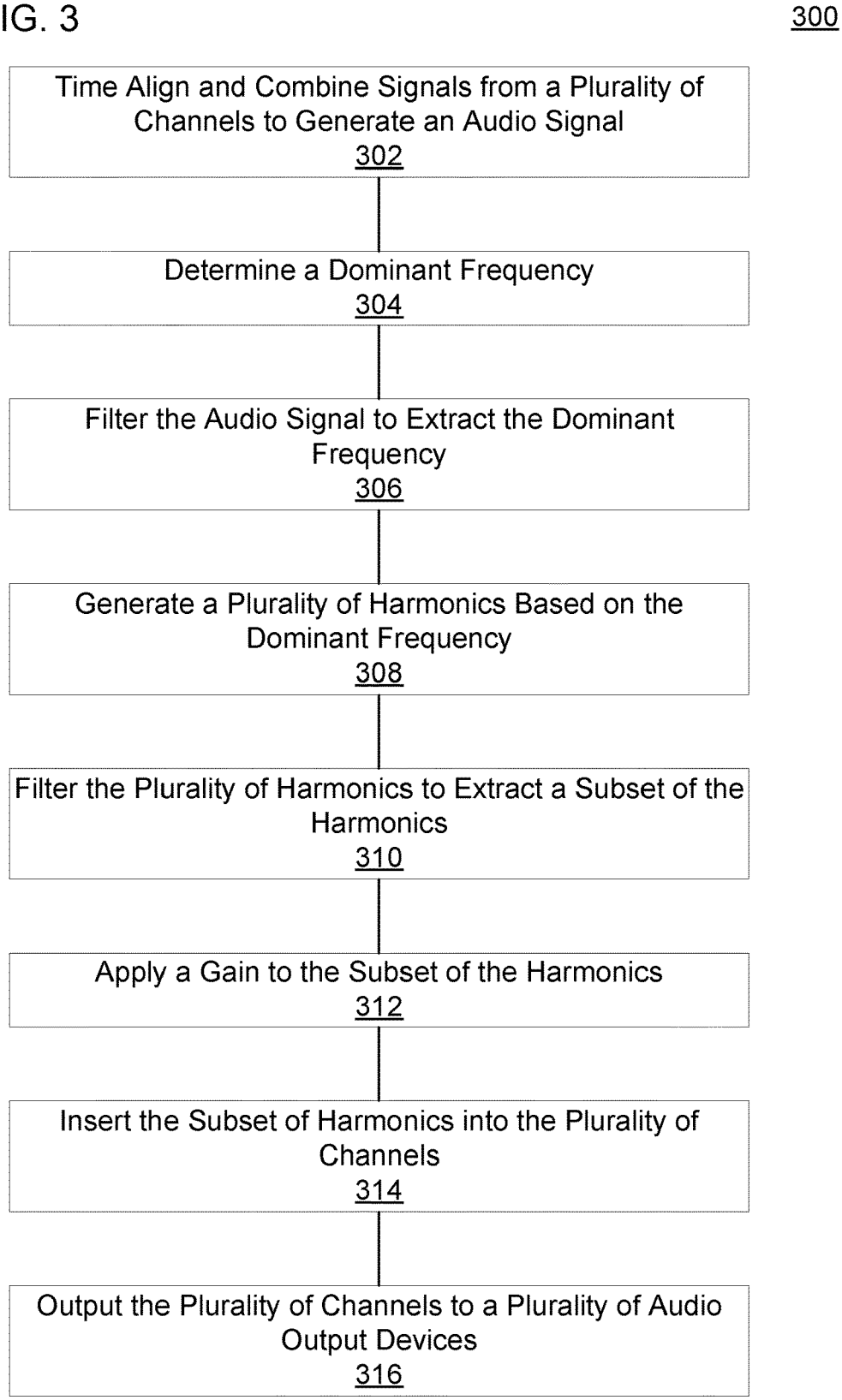
FIG. 3 is a flow diagram of an example method to output audio channels that create the perception of a low frequency component.

FIG. 3 is a flow diagram of an example method 300 to output audio channels that create the perception of a low frequency component. A processor may perform the method 300. At block 302, the method 300 may include time aligning and combining signals from a plurality of channels to generate an audio signal. For example, the signals from the plurality of channels may have phase differences, and the time aligning may prevent cancellation when the signals are combined. Combining the signals may including summing the signals.

At block 304, the method 300 may include determining a dominant frequency. The dominant frequency may be determined based on a maximum in a smoothed spectrum of the audio signal. For example, a spectrum of the combined audio signal may be smoothed, and a maximum in the spectrum may be detected. The frequency of the maximum may be selected as the dominant frequency. Block 306 may include filtering the audio signal to extract the dominant frequency. For example, a filter may be applied to the audio signal. The dominant frequency may be in a passband of the filter, but other frequencies more than a predetermined distance from the passband may be outside the passband. Frequency components outside the passband may be damped or removed while the dominant frequency remains.

At block 308, the method 300 may include generating a plurality of harmonics based on the dominant frequency. For example, non-linear processing may be applied to the filtered audio signal to produce a signal containing the plurality of harmonics. At block 310, the method 300 may include filtering the signal containing the plurality of harmonics to extract a subset of the plurality of harmonics. For example, the filtering may remove the dominant frequency or any harmonics below the capabilities of an audio output device. The filtering may also, or instead, remove harmonics that contribute little to the perception of the dominant frequency. Thus, the remaining harmonics may be within the capabilities of an audio output device and may contribute much to the perception of the dominant frequency.

Block 312 may include applying a gain to the subset of harmonics. The subset of harmonics may have a small amplitude relative to the audio signal, so applying the gain may amplify the subset of harmonics. At block 314, the method 300 may include inserting the amplified subset of harmonics into the plurality of channels. The signals from the plurality of channels may have undergone additional processing during generation of the amplified subset of harmonics. Accordingly, inserting the amplified subset of harmonics into the plurality of channels may include combining the amplified subset of harmonics with signals in the plurality of channels, which signals may be modified versions of the signals discussed in regards to block 302. At block 316, the method 300 may include outputting the plurality of channels to a plurality of audio output devices. For example, the plurality of audio output devices may be driven with the signals with the inserted harmonics. Referring to FIG. 2, in an example, the alignment engine 210 may perform block 302; the frequency selection engine 225 may perform block 304; the first filter engine 230 may perform block 306; the harmonics engine 240 may perform block 308; the second filter engine 250 may perform block 310; the parametric filter engine 260 may perform block 312; and the insertion engine 290 may perform blocks 314 or 316.

Figure 4:
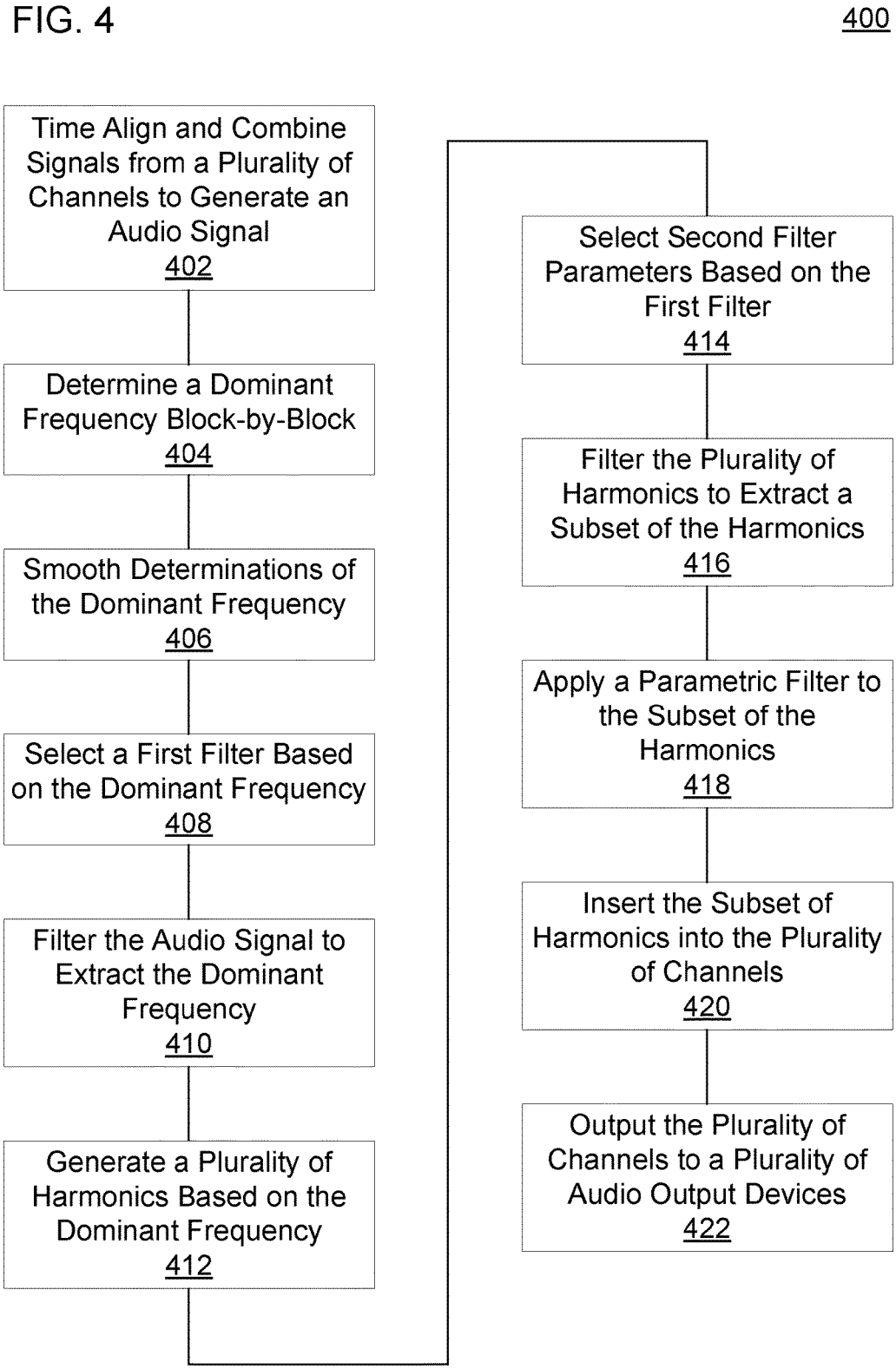
FIG. 4 is a flow diagram of another example method to output audio channels that create the perception of a low frequency component.

FIG. 4 is a flow diagram of another example method 400 to output audio channel that creates the perception of a low frequency component. A processor may perform the method 400. At block 402, the method 400 may include time aligning and combining signals from a plurality of channels to generate a combined audio signal. A correlation, such as a cross-correlation, may be computed for the signals to determine offsets between the signals. The correlation may be computed for the entire spectrum of the signals, for a low frequency portion of the signals, for a plurality of sub-bands of the signals (e.g., a plurality of sub-bands in a low frequency portion of the signals), or the like. The signals may be time shifted by the determined offsets. For example, the entirety of each signal may be time shifted by the corresponding offset, or each individual sub-band may be time shifted based on a corresponding offset. The time-shifted signals or time-shifted sub-bands may be summed to generate the combined audio signal.

At block 404, the method 400 may include determining a dominant frequency based on a maximum in a smoothed spectrum of the combined audio signal block-by-block. In an example, the smoothed spectrum of the combined audio signal may be computed by generating an LPC model of the combined audio signal. The maximum in the smoothed spectrum may be determined by computing a gradient of the smoothed spectrum and using the gradient to find the maximum. The frequency corresponding to the maximum may be selected as the dominant frequency. In some examples, multiple dominant frequencies may be selected, such as a predetermined number of dominant frequencies, dominant frequencies above a threshold (e.g., an absolute threshold, a threshold relative to a most dominant frequency, etc.), at least a minimum number or no more than maximum number of dominant frequencies that satisfy the threshold, or the like. When selecting dominant frequencies, predetermined criteria may be applied, such as selecting only maximums, selecting maximums more than a predetermined distance apart, etc. The dominant frequency may be determined block-by-block. For example, a dominant frequency may be selected in each block of samples received. The blocks may be non-overlapping, may be shifted by a single sample, may be shifted by multiple samples, or the like.

Block 406 may include smoothing determinations of the dominant frequency. Smoothing the determinations of the dominant frequency may prevent a large change between a first dominant frequency for a first block and a second dominant frequency for a second block. For example, there may be large changes in the dominant frequency for non-overlapping blocks or for large shifts between blocks. Such large changes may produce distortion in the audio output to the user. A smoothing filter may be applied to the determinations of the dominant frequency to prevent large changes in the dominant frequency.

At block 408, the method 400 may include selecting a first filter based on the dominant frequency. Selecting the first filter may include selecting a bandpass filter that includes a passband near the dominant frequency. The bandwidth may be selected to remove frequency components unlikely to be related to the dominant frequency. In some examples, selecting the first filter may include selecting an auditory filter with a center frequency nearest to the dominant frequency from among a plurality of auditory filters. Selecting the first filter may include synthesizing the first filter based on selected parameters, retrieving the selected first filter from a computer-readable medium, or the like. At block 410, the method 400 may include filtering the audio signal to extract the dominant frequency. For example, the selected first filter may be applied to the combined audio signal.

At block 412, the method 400 may include generating a plurality of harmonics based on the dominant frequency. Generating the plurality of harmonics may include applying non-linear processing to the filtered audio signal. The non-linear processing may produce copies of the signal at integer multiples of the dominant frequency. Generating the plurality of harmonics may include generating a signal that includes the dominant frequency and the plurality of harmonics.

At block 414, the method 400 may include selecting second filter parameters based on the first filter. Selecting the second filter parameters may include selecting a second filter that removes harmonics below capabilities of an audio output device and removes harmonics that contribute little to the perception of the dominant frequency. The second filter may also remove the dominant frequency. A lower cutoff of the second filter may be selected to be a first integer multiple of the lower cutoff of the first filter, and the upper cutoff of the second filter may be selected to be a second integer multiple of the upper cutoff of the first filter. The first integer multiple may be different from the second integer multiple. The first and second integers may be predetermined or may be selected based on the dominant frequency. The second filter may be synthesized based on the cutoff frequencies, may be retrieved from a computer-readable medium, or the like. At block 416, the method 400 may include filtering the plurality of harmonics to extract a subset of the harmonics. For example, the second filter may be applied to the signal that includes the plurality of filters. The output of the second filter may be a signal that includes the subset of harmonics not removed by the second filter.

At block 418, the method 400 may include applying a gain to the subset of the harmonics. In some examples, applying the gain may include applying a parametric filter to the signal that includes the subset of harmonics. The parametric filter may be selected based on the cutoff frequencies of the second filter and a gain to be applied. For example, the parametric filter may be synthesized based on the cutoff frequencies of the second filter and the gain to be applied. In some examples, the parametric filter may be a biquad filter. At block 420, the method 400 may include inserting the subset of harmonics into the plurality of channels. For example, the signal that includes the subset of harmonics may be added to signals in the plurality of channels. The signals in the plurality of channels may be modified versions of the signals in the plurality of channels in block 402. For example, the signals may undergo a delay to compensate for the time to perform blocks 402-418, may be high-pass filtered to remove frequency components outside the capabilities of an audio output device, or the like.

Block 422 may include outputting the plurality of channels to a plurality of audio output devices. For example, the signals on the plurality of channels may be provided to a plurality of output connections. The output connections may connect directly or indirectly to the plurality of audio output devices. For example, the output connections may be connected to the plurality of audio output devices via a wired connection, a wireless connection, or the like. In some examples, an amplifier, a wireless transceiver, or the like may be interposed between the output connections and the audio output devices. Outputting the plurality of channels may include transmitting the signals on the plurality of channels to the output connections. In some examples, the alignment engine 210 of FIG. 2 may perform block 402; the frequency selection engine 225 may preform blocks 404 or 406; the first filter selection engine 235 may perform block 408; the first filter engine 230 may perform block 410; the harmonics engine 240 may perform block 412; the second filter selection engine 255 may perform block 414; the second filter engine 250 may perform block 416; the parametric filter engine 260 may perform block 418; and the insertion engine 290 may perform blocks 420 or 422.

Figure 5:
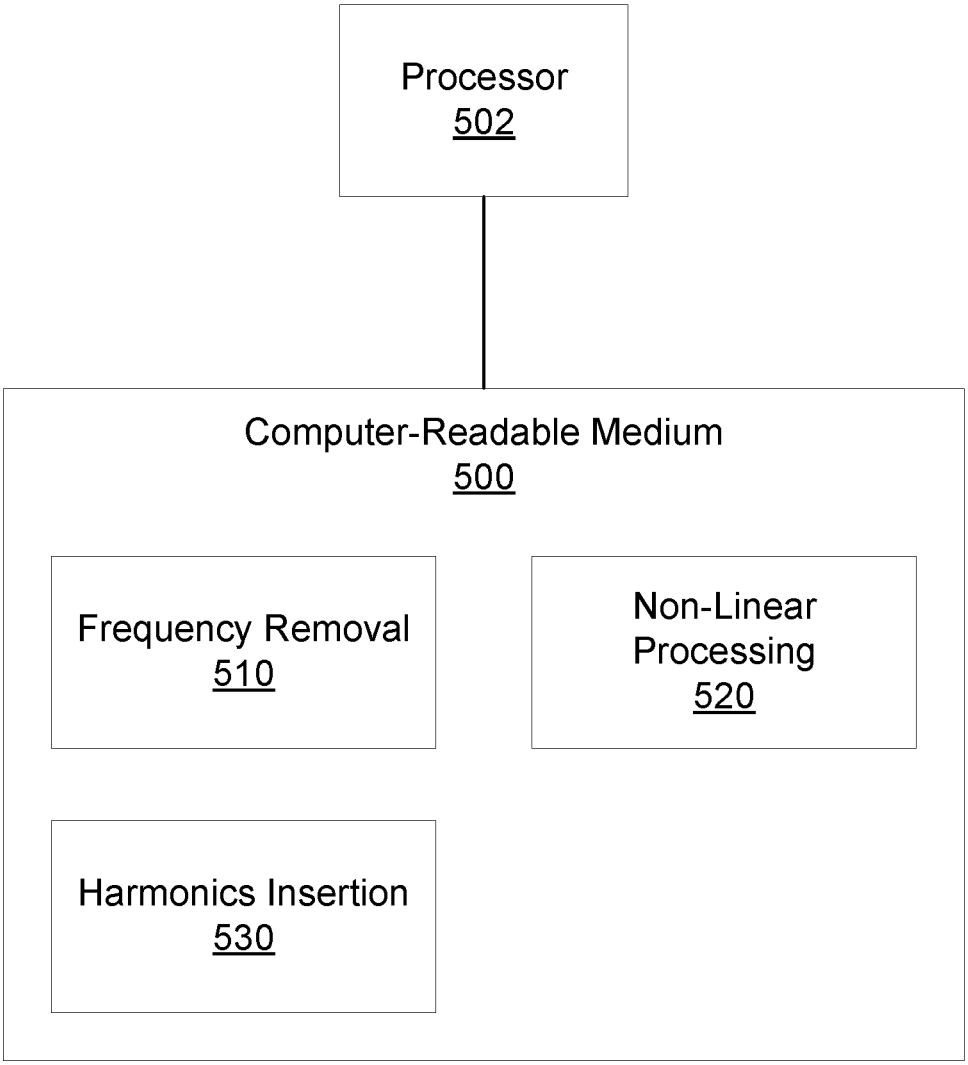
FIG. 5 is a block diagram of an example computer-readable medium including instructions that cause a processor to produce an audio output that creates the perception of a low frequency component.

FIG. 5 is a block diagram of an example computer-readable medium 500 including instructions that, when executed by a processor 502, cause the processor 502 to produce an audio output that creates the perception of a low frequency component. The computer-readable medium 500 may be a non-transitory computer readable medium, such as a volatile computer readable medium (e.g., volatile RAM, a processor cache, a processor register, etc.), a non-volatile computer readable medium (e.g., a magnetic storage device, an optical storage device, a paper storage device, flash memory, read-only memory, non-volatile RAM, etc.), and/or the like. The processor 502 may be a general purpose processor or special purpose logic, such as a microprocessor, a digital signal processor, a microcontroller, an ASIC, an FPGA, a programmable array logic (PAL), a programmable logic array (PLA), a programmable logic device (PLD), etc.

The computer-readable medium 500 may include a frequency removal module 510. As used herein, a "module" (in some examples referred to as a "software module") is a set of instructions that when executed or interpreted by a processor or stored at a processor-readable medium realizes a component or performs a method. The frequency removal module 510 may include instruction that, when executed, cause the processor 502 to remove nondominant frequencies from a low frequency portion of an audio signal. For example, the audio signal may include dominant frequency components and nondominant frequency components, and the frequency removal module 510 may cause the processor 502 to remove the nondominant frequency components.

The computer-readable medium 500 may include a non-linear processing module 520. The non-linear processing module 520 may cause the processor 502 to apply non-linear processing to a remainder of the low frequency portion. The remainder of the low frequency portion may include the components of the audio signal left after removal of the nondominant frequency. The application of the non-linear processing may generate a plurality of harmonics.

The computer-readable medium 500 may include a harmonics insertion module 530. The harmonics insertion module 530 may cause the processor 502 to insert the plurality of harmonics into an audio output. The audio output may correspond to a high frequency portion of the audio signal. The high frequency portion of the audio signal may have a spectrum that overlaps with the low frequency portion, a spectrum that is adjacent to the low frequency portion, a spectrum separated from the low frequency portion by a gap, or the like. The harmonics insertion module 530 may insert the plurality of harmonics by combining the plurality of harmonics with the audio output. The audio output may be to be provided to an audio output device. In an example, the frequency removal module 510, when executed by the processor 502, may realize the first filter engine 120 of FIG. 1; the non-linear processing module 520, when executed by the processor 502, may realize the harmonics engine 130; and the harmonics insertion module 530, when executed by the processor 502, may realize the insertion engine 140.

Figure 6:
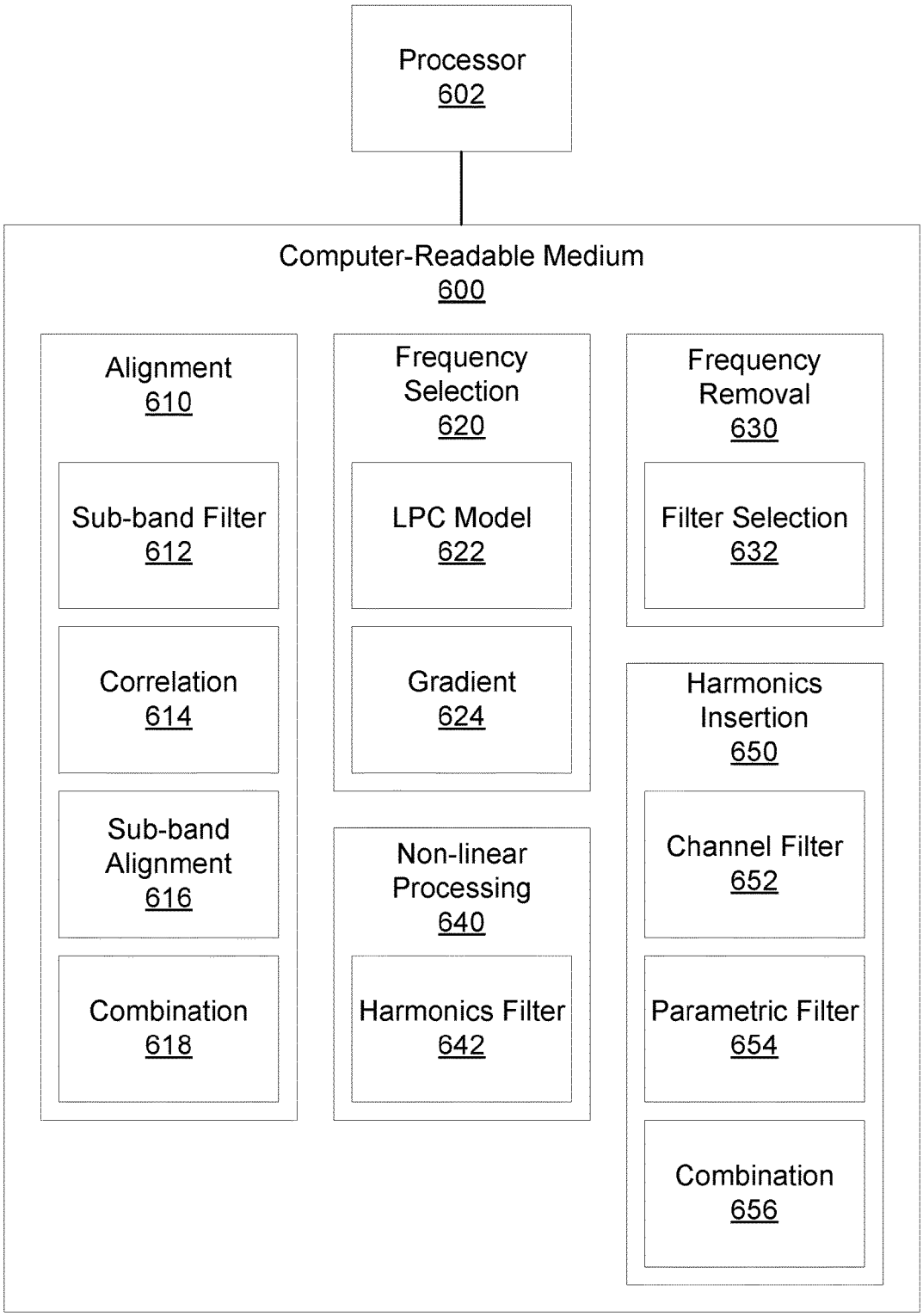
FIG. 6 is a block diagram of another example computer-readable medium including instructions that cause a processor to produce an audio output that creates the perception of a low frequency component.

FIG. 6 is a block diagram of another example computer-readable medium 600 including instructions that, when executed by a processor 602, cause the processor 602 to produce an audio output that creates the perception of a low frequency component. The computer-readable medium 600 may include an alignment module 610. The alignment module 610 may cause the processor 602 to align and combine a plurality of channel signals. The alignment module 610 may include a sub-band filter module 612. The sub-band filter module 612 may cause the processor 602 to filter a plurality of channel signals to generate a plurality of sub-band signals for each channel signal. For example, the sub-band filter module 612 may cause the processor 602 to extract a plurality of sub-band signals that are partially overlapping, adjacent, separated by gaps, or the like. The sub-band filter module 612 may cause the processor 602 to extract the plurality of sub-band signals from a low frequency portion of each channel signal (e.g., a portion of each channel signal below the capabilities of an audio output device). In an example, the sub-band filter module 612 may cause the processor 602 to apply identical or similar sub-band filters to each channel signal.

The alignment module 610 may include a correlation module 614. The correlation module 614 may cause the processor 602 to compute a correlation for corresponding sub-band signals from the plurality of channel signals. Corresponding sub-band signals may be sub-band signals generated from different channel signals using identical or similar sub-band filters. In some examples, the correlation module 614 may cause the processor 602 to compute a cross-correlation between the corresponding sub-band signals.

The alignment module 610 may include a sub-band alignment module 616. The sub-band alignment module 616 may cause the processor 602 to align the corresponding sub-band signals based on the correlation. For example, the sub-band alignment module 616 may cause the processor 602 to determine an offset between the sub-band signals based on a maximum in the cross-correlation computation. The sub-band alignment module 616 may cause the processor 602 to time shift the sub-band signals based on the offset to align the sub-band signals. The alignment module 610 may include a combination module 618. The combination module 618 may cause the processor 602 to combine the aligned sub-band signals to produce a combined audio signal. For example, the combination module 618 may cause the processor 602 to sum all of the sub-band signals from all of the channels.

The computer-readable medium 600 may include a frequency selection module 620. The frequency selection module 620 may cause the processor 602 to select a dominant frequency in the spectrum of the combined audio signal. The frequency selection module 620 may include an LPC model module 622. The LPC model module 622 may cause the processor 602 to generate an LPC model of the audio signal. The spectrum of the LPC model may be a smoothed version of the spectrum of the audio signal. The frequency selection module 620 may also include a gradient module 624. The gradient module 624 may cause the processor 602 to determine a dominant frequency based on a gradient of the spectrum of the LPC model. For example, the gradient module 624 may cause the processor 602 to compute a gradient of the spectrum of the LPC model. The gradient module 624 may cause the processor 602 to determine a maximum in the spectrum of the LPC model and select a frequency corresponding to the maximum as the dominant frequency.

The computer-readable medium 600 may include a frequency removal module 630. The frequency removal module 630 may cause the processor 602 to remove nondominant frequencies from a low frequency portion of the combined audio signal. The sub-band filter module 612 may have already caused the processor 602 to remove a high frequency portion of the audio signal. Accordingly, the frequency removal module 630 may cause the processor 602 to filter the combined audio signal to remove the nondominant frequencies from the low frequency portion of the combined audio signal. The frequency removal module 630 may include a filter selection module 632. The filter selection module 632 may cause the processor 602 to select a filter corresponding to an auditory filter with a center frequency closest to the dominant frequency. For example, the dominant frequency may be in a passband of the filter corresponding to the auditory filter, and nondominant frequencies may be outside the passband of the filter. The filter selection module 632 may cause the processor 602 to select the filter by synthesizing the filter corresponding to the auditory filter, by retrieving the filter from a computer-readable medium, or the like. The frequency removal module 630 may cause the processor 602 to apply the selected filter to the combined audio signal to remove the nondominant frequencies. Applying the selected filter may produce a filtered signal containing the dominant frequency.

The computer-readable medium 600 may include a non-linear processing module 640. The non-linear processing module 640 may cause the processor 602 to apply non-linear processing to a remainder of the low frequency portion after removal of the nondominant frequencies. For example, the non-linear processing module 640 may cause the processor 602 to apply the non-linear processing to the filtered signal produced by the frequency removal module 630. The application of the non-linear processing may generate a plurality of harmonics. The non-linear processing module 640 may include a harmonics filter module 642. The harmonics filter module 642 may cause the processor 602 to filter an output from the non-linear processing. For example, the harmonics filter module 642 may cause the processor 602 to remove harmonics that contribute little to perception of a dominant frequency and to remove harmonics with frequencies below the capabilities of an audio output device. The harmonics that contribute little to perception of the dominant frequency may be harmonics above a third harmonic, a fourth harmonic, a fifth harmonic, a six harmonic, a seventh harmonic, an eighth harmonic, a ninth harmonic, a tenth harmonic, etc. The result of the filtering may be a plurality of harmonics to be inserted into the plurality of channel signals.

The computer-readable medium 600 may include a harmonics insertion module 650. The harmonics insertion module 650 may cause the processor 602 to insert the plurality of harmonics into an audio output corresponding to a high frequency portion of the audio signal. In some examples, the harmonics insertion module 650 may include a channel filter module 652. The channel filter module 652 may cause the processor 602 to filter each of the plurality of channel signals to remove the low frequency portion of each signal. For example, the channel filter module 652 may cause the processor 602 to produce the audio output corresponding to the high frequency portion of the audio signal by filtering the plurality of channel signals. In some examples, a compensating delay or other processing may be applied in addition to or instead of the filtering.

The harmonics insertion module 650 may include a parametric filter module 654. The parametric filter module 654 may cause the processor 650 to apply a parametric filter to the plurality of harmonics to amplify the plurality of harmonics. For example, the parametric filter module 654 may cause the processor 602 to generate a parametric filter based on a bandwidth of the filter used by the harmonics filter module 642 and based on a gain to be applied to the plurality of harmonics. The parametric filter module 654 may cause the processor 602 to apply the generated filter to the plurality of harmonics to amplify the plurality of harmonics. In some examples, applying a uniform gain can add to the harmonic distortion due to loudspeaker total-harmonic-distortion (THD) limits being exceeded, so the parametric filter module 654 may cause the processor 602 to apply the parametric filter instead of the uniform gain.

The harmonics insertion module 650 may include a combination module 656. The combination module 656 may cause the processor 602 to combine the output of the parametric filter with the audio output produced by filtering each of the channel signals. For example, the combination module 656 may add the output of the parametric filter to each filtered channel signal. In some examples, the harmonics insertion module 650 may cause the processor 602 to output the channel signals with the added harmonics directly or indirectly to an audio output device. Referring to FIG. 2, when executed by the processor 602, the alignment module 610 may realize the alignment engine 210, for example; the sub-band filter module 612 may realize the sub-band filters engine 214; the correlation module 614 or the sub-band alignment module 616 may realize the correlation engine 212; the combination module 618 may realize the alignment engine 210; the LPC model module 622 may realize the modeling engine 220; the gradient module 624 may realize the frequency selection engine 225; the filter selection module 632 may realize the first filter selection engine 235; the frequency removal module 630 may realize the first filter engine 230; the non-linear processing module 640 may realize the harmonics engine 240; the harmonics filter module 642 may realize the second filter engine 250 or the second filter selection engine 255; the channel filter module 652 may realize the high-pass filter engine 280; the parametric filter module 654 may realize the parametric filter engine 260; and the combination module 656 may realize the insertion engine 290.

The above description is illustrative of various principles and implementations of the present disclosure. Numerous variations and modifications will become apparent to those skilled in the art once the above disclosure is fully appreciated. Accordingly, the scope of the present application should be determined only by the following claims.

What is claimed is:

1. A system comprising:

a frequency selection engine to select a dominant frequency in an audio signal based on a maximum in a smoothed version of a spectrum of the audio signal;

a first filter engine to extract the dominant frequency from the audio signal;

a harmonics engine to generate a plurality of harmonics of the dominant frequency; and an insertion engine to insert the plurality of harmonics into an audio output corresponding to the audio signal, the audio output to be provided to an audio output device.

2. The system of claim 1, wherein the first filter engine applies a filter corresponding to a critical band of an auditory filter to extract the dominant frequency.

3. The system of claim 1, further comprising a modeling engine to generate a linear predictive coding (LPC) model of the audio signal, wherein the frequency selection engine selects the dominant frequency based on a maximum in a spectrum of the LPC model of the audio signal.

4. The system of claim 1, further comprising an alignment module to time align channel signals from a plurality of audio channels and combine the time aligned channel signal to produce the audio signal, wherein the insertion engine is to insert the plurality of harmonics into an audio output for each audio channel.

5. The system of claim 4, wherein the alignment module comprises a plurality of sub-band filters to split each channel signal into a plurality of channel sub-band signals, wherein the alignment module is to time align corresponding sub-band signals from the plurality of audio channels, and wherein the alignment module is to combine the time aligned sub-band signals to produce the audio signal.

6. A method, comprising:

time aligning and combining signals from a plurality of channels to generate an audio signal;

determining a dominant frequency based on a maximum in a smoothed spectrum of the audio signal;

filtering the audio signal to extract the dominant frequency;

generating a plurality of harmonics based on the dominant frequency;

filtering the plurality of harmonics to extract a subset of the harmonics;

applying a gain to the subset of the harmonics;

inserting the subset of the harmonics into the plurality of channels; and outputting the plurality of channels to a plurality of audio output devices.

7. The method of claim 6, wherein determining the dominant frequency comprises determining a first dominant frequency in a first block of samples from the audio signal and determining a second dominant frequency in a second block of samples from the audio signal, and wherein the first and second blocks of samples are non-overlapping.

8. The method of claim 7, further comprising smoothing determinations of the dominant frequency to prevent a large change between the first dominant frequency and the second dominant frequency.

9. The method of claim 6, wherein filtering the audio signal to extract the dominant frequency comprises applying a first filter corresponding to a critical band of an auditory filter, wherein the first filter includes a first lower cutoff frequency and a first upper cutoff frequency, and wherein filtering the plurality of harmonics comprises applying a second filter having a second lower cutoff frequency that is a first integer multiple of the first lower cutoff frequency and a second upper cutoff frequency that is a second integer multiple of the second lower cutoff frequency.

10. The method of claim 6, wherein applying the gain comprises applying a parametric filter to the subset of the harmonics.

11. A non-transitory computer-readable medium comprising instructions that, when executed by a processor, cause the processor to:

remove nondominant frequencies from a low frequency portion of an audio signal;

apply non-linear processing to a remainder of the low frequency portion to generate a plurality of harmonics; and insert the plurality of harmonics into an audio output corresponding to a high frequency portion of the audio signal, the audio output to be provided to an audio output device.

12. The computer-readable medium of claim 11, wherein the instructions cause the processor to:

filter a plurality of channel signals to generate a plurality of sub-band signals for each channel signal;

compute a correlation for corresponding sub-band signals from the plurality of channel signals;

align the corresponding sub-band signals based on the correlation; and combine the aligned corresponding sub-band signals to produce the audio signal.

13. The computer-readable medium of claim 11, wherein the instructions cause the processor to:

generate a linear predictive coding (LPC) model of the audio signal; and determine a dominant frequency based on a gradient of a spectrum of the LPC model.

14. The computer-readable medium of claim 13, wherein the instructions cause the processor to:

select a filter corresponding to an auditory filter with a center frequency closest to the dominant frequency; and apply the selected filter to remove the nondominant frequencies.

15. The computer-readable medium of claim 11, wherein the instructions cause the processor to:

filter each of a plurality of channel signals to remove the low frequency portion of each channel signal;

filter an output from the non-linear processing to remove harmonics that contribute little to perception of a dominant frequency and to remove harmonics below the capabilities of an audio output device, wherein the filtering is to produce the plurality of harmonics to be inserted; and apply a parametric filter to the plurality of harmonics to amplify the plurality of harmonics, wherein inserting the plurality of harmonics comprises combining the output of the parametric filter with each filtered channel signal.

* * * * *